US005343647A

United States Patent [19]

Bulka

[11] Patent Number: 5,343,647

[45] Date of Patent: Sep. 6, 1994

[54] PRESSURE SENSITIVE PRICING TAG/LABEL

[75] Inventor: Tricia Bulka, Merrimack, N.H.

[73] Assignee: Moore Business Forms, Inc., Grand Island, N.Y.

[21] Appl. No.: 753,994

[22] Filed: Sep. 3, 1991

[51] Int. Cl.[5] ..... G09F 3/10

[52] U.S. Cl. ..... 40/630; 40/638

[58] Field of Search ..... 40/630, 638; 283/79, 283/81, 101

[56] References Cited

U.S. PATENT DOCUMENTS

| | | | |
|---|---|---|---|
| 2,246,365 | 6/1941 | Kohnle . | |
| 3,628,266 | 12/1971 | Wise et al. . | |
| 4,110,502 | 8/1978 | Baer | 283/79 X |
| 4,438,950 | 3/1984 | Hamisch, Jr. | 283/70 |
| 4,457,539 | 7/1984 | Hamisch, Jr. . | |
| 4,637,635 | 1/1987 | Levine | 283/101 |
| 4,700,976 | 10/1987 | Loose | 283/101 |
| 4,726,131 | 2/1988 | Cass . | |
| 4,799,712 | 1/1989 | Biava et al. | 283/81 X |
| 4,927,179 | 5/1990 | Ehret et al. | 283/81 X |
| 4,951,970 | 8/1990 | Burt | 283/79 X |
| 4,978,144 | 12/1990 | Schmidt et al. | 283/70 |
| 4,983,438 | 1/1991 | Jameson | 40/630 X |

*Primary Examiner*—Kenneth J. Dorner
*Assistant Examiner*—J. Bonifanti
*Attorney, Agent, or Firm*—Nixon & Vanderhye

[57] ABSTRACT

A versatile paperboard panel can be used to attach identifying (e.g. price) information to a wide variety of articles. A release coating is applied to a first face of the panel, and a label having an adhesive face is disposed over the panel with the adhesive in contact with the release coating. A perforation allows separation of the panel into first and second portions. The first portion contains the label, and the second portion includes an opening capable of receiving an attachment mechanism (such as a hook or string). A number of panels may be provided in a cut or continuous sheet that may be fed through a printer, the sheet having a first layer of paperboard which forms the panels, and a second layer of paper which forms the labels, with adhesive attached to the paper and a release coat to the panel. The labels are die cut from the second layer, and the panels are die cut from the first layer. Tractor holes may be provided along edges of the sheet to facilitate feeding through a printer, which prints the identifying indicia on the labels. The panels may be used by placing an attachment mechanism connected to the article into association with the panel second portion opening, or removing the label from the panel and applying it to the article, or separating the panel along the perforation and attaching the first portion of the panel (with the label still attached) to the article (e.g. by sliding it into a channel).

15 Claims, 3 Drawing Sheets

PRESSURE SENSITIVE PRICING TAG/LABEL

BACKGROUND AND SUMMARY OF THE INVENTION

There are many retailers, or others handling merchandise, that utilize a number of different price tags or labels to apply to merchandise depending upon the particular configuration of the merchandise, or the manner in which it is displayed. Keeping a separate inventory of these different types of price tags and labels can be burdensome. Also, many retailers or the like wish to imprint the price tags or labels in a neat, easily readable, and mass production form, desirably by running the price tags or labels through a printer (such as a laser printer, or impact printer). It can be difficult to match conventionally available pricing tags or labels that can be fed through a printer to the particular needs of the retailer.

The invention seeks to overcome the problems described above by providing an identifying device that is both highly versatile and capable of running through a printer in sheet format so that a plurality of identifying devices can be printed with variable information at the same time. Despite these advantages, the identifying devices according to the invention are extremely simple, and relatively inexpensive.

According to one aspect of the present invention, an identifying device is provided which comprises the following elements: A panel having first and second faces. A release coating applied to at least a first area of the panel first face. A label having an adhesive face, and disposed over the first area of the panel first face with the adhesive face in contact with the release coating, the label having dimensions significantly less than the dimensions of the panel. Means defining a line of weakness in the panel for allowing separation of the panel along the line of weakness, and dividing the panel into first and second portions, the label being disposed in the first portion. And, means defining an opening capable of receiving an attachment mechanism in the second portion of the panel. The opening in the panel second portion may be a circular perforation, the line of weakness may be a perforation, and the panel is preferably paperboard and the label is paper. The panel is typically quadrate, and the release coating is over the entire first face of the panel. The adhesive typically is removable or permanent adhesive, although if repositional adhesive is used then the "release coating" need only be a smooth face of the paperboard.

According to another aspect of the present invention, a machine feedable sheet of identifying devices is provided. The sheet comprises the following elements: A first layer of paperboard having first and second faces. A release coating on the first face of the first layer. A second layer comprising paper having first and second faces. Adhesive on the first face. The second layer overlying the first layer so that the first faces thereof are in contact with each other. Means defining a plurality of die cut quadrate openings, each having a first area, in the second layer, to define labels. Means defining a plurality of die cut quadrate openings, each having a second area, in the first layer, to define identifying panels. The second area being significantly greater than the first area. And, means facilitating feeding of the sheet into a machine for printing indicia on the labels. The individual panels preferably are constructed as described above with respect to the first aspect of the invention.

The invention also contemplates a method of using an identifying paperboard panel. The method comprises the following steps: (a) Printing identifying indicia (such as price indicia) on the label. And, (b) attaching the panel to an article which is to be identified by practicing, at the discretion of the user, one of the following substeps: (i) placing an attachment mechanism connected to the article into association with the panel opening, or (ii) removing the label from the panel and applying it to the article so that the label adhesive adheres it to the article, or (iii) separating the panel along the line of weakness and attaching the first portion of the panel, with label still attached thereto, to the article. A plurality of panels are preferably provided in a common sheet, and step (a) is practiced by automatically feeding the sheet through a printer so that at least a plurality of the labels are printed with identifying information. There is then the further step (c), between steps (a) and (b), of separating individuals panels from the sheet.

It is the primary object of the present invention to provide a versatile and easily machine printable identifying device to be utilized as a pricing tag or label. This and other objects of the invention will become clear from an inspection of the detailed description of the invention, and from the appended claims.

DETAILED DESCRIPTION OF THE DRAWINGS

Figure 1:
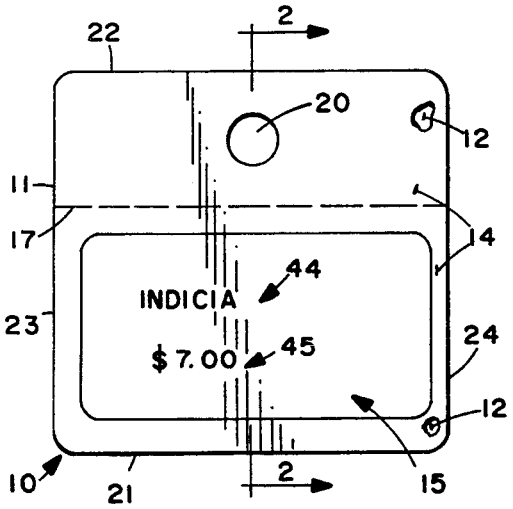
FIG. 1 is a top plan view of an exemplary identifying device according to the invention.
Figure 3:
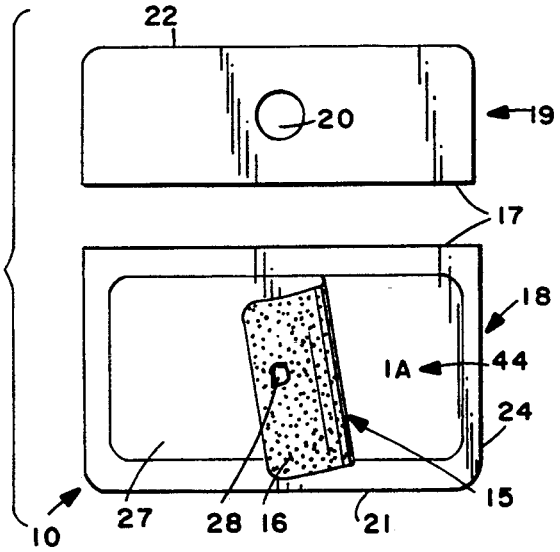
FIG. 3 is a view like that of FIG. 1 only showing the portions of the panel detached, and the label being peeled back from the panel.
Figure 2:
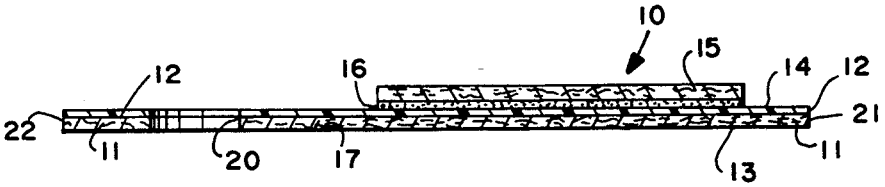
FIG. 2 is a cross-sectional view, taken along lines 2—2 of FIG. 1, of the device of FIG. 1.

An exemplary identifying device according to the present invention is shown generally by reference numeral 10 in FIGS. 1 through 3. The device 10 includes a panel 11 having first and second faces 12, 13, respectively. A release coating 14 is applied to at least a first area of the panel first face 12 (e.g. below the label 15), and preferably the release coating 14 is applied over the entire panel 11, as illustrated in the drawings. The release coating 14 can be any conventional release coating and it depends upon the particular type of adhesive 16 (see FIGS. 2 and 3) utilized with the label 15. If the adhesive is a conventional removable or permanent adhesive, the release coating 14 will be a conventional silicone-like coating. If the adhesive 16 is a low strength, or repositional adhesive, then the "release coating" need only be a smooth surface of the face 12.

The label 15 has significantly smaller dimensions than the panel 11, e.g. covering only about 40 to 50 percent of the panel. The label 15 is typically of a conventional paper having a weight and combination conventionally used for paper labels, however it can comprise other materials, such as plastic. The panel 11 may also comprise a variety of materials, but preferably is paperboard. The term "paperboard" as used in the present specification and claims encompasses all primarily cellulosic based materials between heavyweight paper and lightweight cardboard, and preferably has a weight within the range conventional for price tags used in retail establishments, A line of weakness—such as a perforation 17—separates the panel 11 into a first portion 18 and a second portion 19 (see FIG. 3). The first portion 18 includes the label 15 thereon, and has an area somewhat larger than the area of the label 15, so that the label may be easily peeled therefrom. Also a surrounding border for the label provided by the panel first portion 18 tends to highlight the indicia on the label (especially if the label 15 is of a different color—e.g. yellow—than the paperboard panel first face 12—e.g. white). The panel second portion 19 preferably has means defining an opening therein, such as the circular perforation 20 (shown with the circular cutout removed).

It is preferred that the panel 11 be substantially quadrate in configuration, as seen in FIG. 1, having first and second end edges 21, 22 that are parallel to each other and the perforation 17, and first and second side edges 23, 24 parallel to each other. The edges of the label 15 are also parallel to the edges 21 through 24 of the panel 11, the label too preferably being quadrate. The face 27 (see FIG. 3) of the label 15 is visible, while the opposite face 28 has the adhesive 16 thereon.

Figure 4:
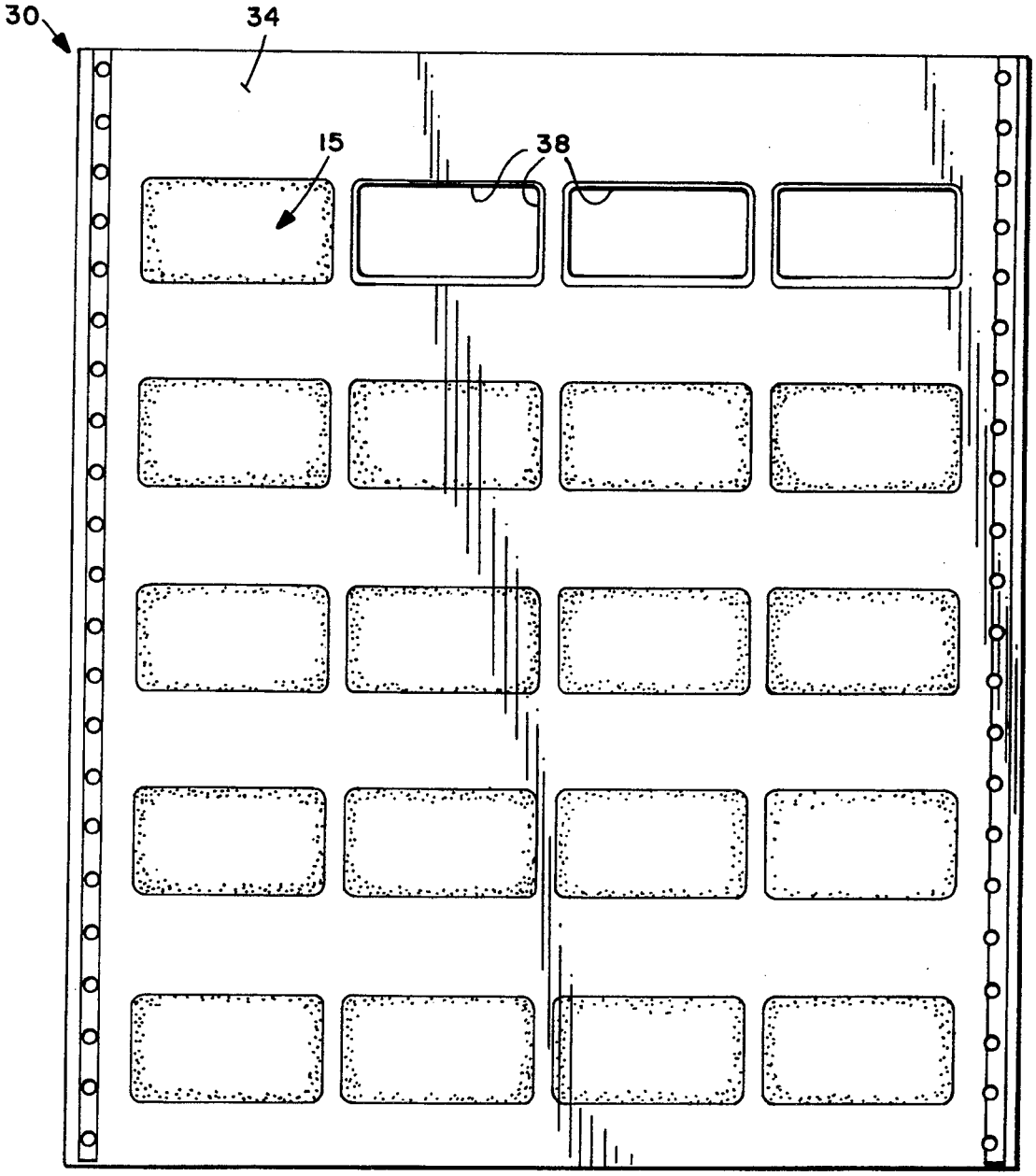
FIGS. 4 and 5 are top and bottom plan views, respectively, of a machine feedable sheet with a plurality of identifying devices according to the invention.
Figure 5:
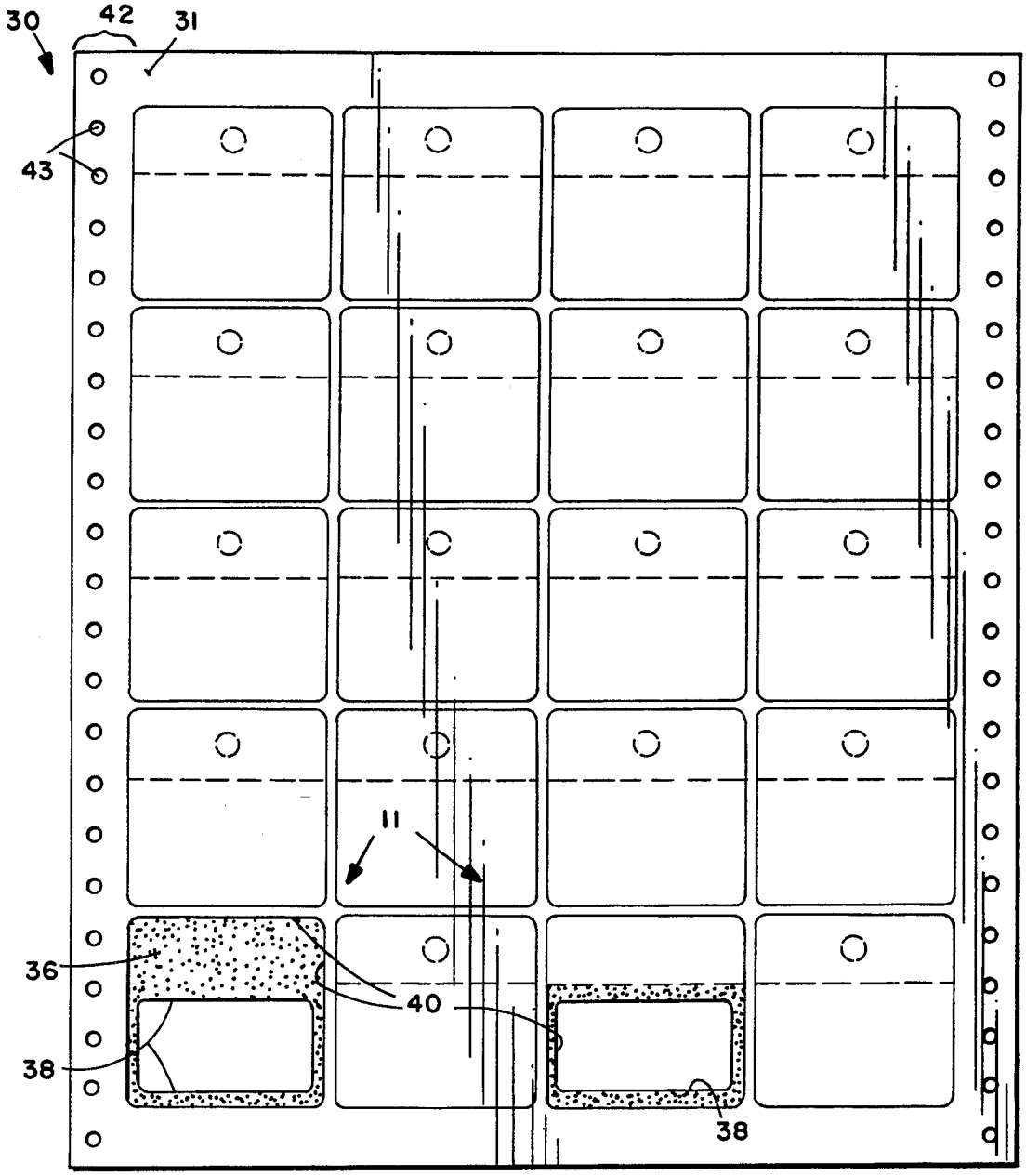
Figure 6:
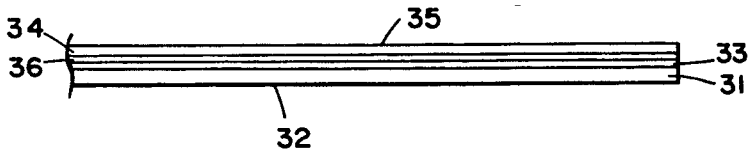
FIG. 6 is a side view of a portion of the sheet of FIGS. 4 and 5.

The aspect of the invention illustrated in FIGS. 4 through 6 is a machine feedable sheet 30 containing identifying devices 10. The sheet 30 comprises a first layer 31 of paperboard, having first and second faces, the second face being the bottom face 32 (see FIG. 6), and the first face being covered with a release coating 33, typically of a wax-like substance. The coating 33, over substantially the entire first layer 31, is the release coating 14 illustrated in FIG. 1.

The sheet 30 also comprises a second layer having first and second faces, with the second face 35 being the top face as illustrated in FIG. 6, and adhesive 36 (corresponding to the adhesive 16 in FIGS. 2 and 3) is disposed covering essentially the entire first face of the second layer 34. The adhesive 36 preferably is a removable adhesive, although it can be a repositional adhesive, or even a permanent adhesive.

The first and second layers 31, 34 are in engagement over the entire extent thereof with the adhesive 36 in contact with the release coating 33. While interruptions may be provided in the adhesive 36 or the release coating 33, none are necessary.

The sheet 30 further comprises means defining a plurality of die cut quadrate openings 38, each having a first area, in the second layer 34, to define labels 15. Also means are provided for defining a plurality of die cut quadrate openings 40 (see FIG. 5) in the first layer 31, to define identifying panels 11. The openings 40 each have a second area which is significantly greater than the first area, as can be readily seen in FIG. 5. A die cut opening 40 corresponds to each die cut opening 38, so that preferably each panel 11 has a label 15 associated therewith, and vice versa. It is noted that any number of die cut openings 38, 40 may be provided in the sheet 30, preferably in rows and columns, such as the four rows and five columns illustrated in FIGS. 4 and 5.

The sheet 30 also preferably comprises means facilitating feeding of the sheet 30 into a machine for printing indicia on the labels, such as a conventional impact or laser printer. The exact form that the means facilitating feeding of the sheet 30 will take depends upon whether the sheet 30 is a cut sheet, part of a continuous form (that is having like sheets at the ends thereof), the particular type of printer to be utilized, etc. In the exemplary form illustrated in the drawings, the means facilitating feeding are the tractor holes 43, which preferably extend through both layers 31, 34, and are disposed along both side edges of the sheet 30. However the means for facilitating feeding may instead merely comprise non-die cut side edge portions of the sheet 30 if the printer with which the sheet 30 is to be utilized has a feeding mechanism capable of grasping and feeding the sheet without the necessity for tractor holes 43.

When the sheet 30 is fed through a printer, variable indicia is printed on the labels 15. Depending upon the printer either the same indicia can be printed on all of the labels 15 associated with the sheet 30, or the indicia may vary from label to label. FIGS. 1 and 3 illustrate indicia 44 that has been printed on a label 15. The identifying indicia 44 may include price information, such as illustrated at 45 in FIG. 1. The indicia 44 is printed on the top face 27 of the label 15 (see FIG. 3).

After the sheet 30 has been passed through a printer so that the indicia 44, 45 is printed thereon, the panels 11 are separated therefrom, to provide the individual devices 10 as illustrated in FIG. 1.

Figure 7:
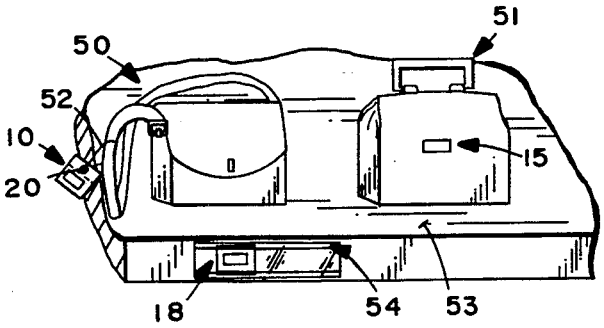
FIG. 7 is a perspective view showing the three different modes of utilization of the device of FIG. 1.

FIG. 7 illustrates three typical manners of use of the device 10 according to the invention, showing its utility and versatility. On the top lefthand side of FIG. 7, an article of merchandise, such as a handbag 50, has a device 10 employed as a tag associated therewith, while another article of merchandise 51 has a device according to the invention employed therewith as a label.

For the article 50, the device 10 is attached thereto by an attachment mechanism, such as a hook or a string or wire 52, which extends through the opening 20 and around a portion of the article 50 so that the indicia 44, 45 on the label are readily visible, the device 10 in this situation comprising a tag.

For marking the article 51, the label 15 has been removed from the panel 11 by grasping an edge thereof and peeling it backwardly (as illustrated in FIG. 3 ) . Then the removable adhesive 16 of the label 15 is applied directly to the article 51, so that the indicia thereon is readily visible as illustrated in FIG. 7.

FIG. 7 also illustrates as an article a shelf 53, which has a conventional price card display channel 54 on the front edge thereof. The third way in which the device 10 according to the invention is utilized is to separate the first and second portions 18, 19 from each other by tearing along the perforation 17, and then taking the first portion 18—with label 15 adhered thereto—and sliding it into operative association with the channel 54, the first portion 18 then serving as a price card as illustrated in FIG. 7.

It will thus be seen that according to the present invention a simple yet highly versatile identifying device, utilizable as a tag, label, or card, is provided. The device may readily be incorporated in sheet form and fed through a printer to have variable data printed thereon. Despite its versatility and functionality, the invention is extremely simple. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. An identifying device, comprising:

a paperboard panel having first and second faces;

a release coating applied to at least a first area of said panel first face;

a label having an adhesive face, and disposed over said first area of said panel first face with said adhesive face in contact with said release coating, said label having dimensions significantly less than the dimensions of said panel;

said panel uncovered except by said label and said release coating;

means defining a line of weakness in said panel for allowing separation of said panel along said line of weakness, and dividing said panel into first and second portions, said label being disposed in said first portion; and means defining an opening capable of receiving an attachment mechanism in said second portion of said panel.

2. An identifying device as recited in claim 1 wherein said panel is substantially quadrate, having first and second end edges parallel to, and spaced from, each other, and first and second side edges parallel to, and spaced from, each other; and wherein said line of weakness is parallel to said end edges.

3. An identifying device as recited in claim 2 wherein said line of weakness is a perforation.

4. An identifying device as recited in claim 3 wherein said label is paper.

5. An identifying device as recited in claim 1 wherein said label is paper.

6. An identifying device as recited in claim 1 further comprising indicia, including price information, on said label, on an opposite face therefrom from said adhesive.

7. An identifying device as recited in claim 6 wherein said label is paper.

8. An identifying device as recited in claim 1 wherein said line of weakness is a perforation.

9. An identifying device as recited in claim 1 wherein said first portion has a larger area than said label.

10. A machine feedable sheet of identifying devices, comprising:

a first layer of paperboard having first and second faces;

a release coating on said first face of said first layer;

a second layer comprising paper having first and second faces;

adhesive on said first face of said second layer;

said second layer overlying said first layer so that said first faces thereof are in contact with each other;

means defining a plurality of die cut quadrate openings, each having a first area, in said second layer, to define labels;

means defining a plurality of die cut quadrate openings, each having a second area, in said first layer, to define identifying panels;

said second area being significantly greater than said first area; and means facilitating feeding of said sheet into a machine for printing indicia on said labels.

11. A sheet as recited in claim 10 wherein each of said panels comprises means defining a line of weakness therein for allowing separation of said panel along said line of weakness, and dividing said panel into first and second portions, a label being disposed in said first portion of each panel.

12. A sheet as recited in claim 11 further comprising means defining an opening capable of receiving a hook in said second portion of said panel.

13. A sheet as recited in claim 12 wherein said means facilitating feeding of said sheet comprise a plurality of tractor holes along at least one edge of said sheet, said tractor holes extending through both said first and second layers.

14. A sheet as recited in claim 10 further comprising means defining an opening capable of receiving a hook or strand in said second area of said panel.

15. A sheet as recited in claim 10 wherein said means facilitating feeding of said sheet comprise a plurality of tractor holes along at least one edge of said sheet, said tractor holes extending through both said first and second layers.

* * * * *